US008513955B2

(12) United States Patent
Rix et al.

(10) Patent No.: US 8,513,955 B2
(45) Date of Patent: Aug. 20, 2013

(54) SSL BUDGETING AND CODING SYSTEM FOR LIGHTING ASSEMBLY

(75) Inventors: Robert D. Rix, Hershey, PA (US); Stephen Jackson, Mount Joy, PA (US); Mohammad Ahmed, Harrisburg, PA (US); Gerald Wingle, Jr., Reinholds, PA (US); Dean Perronne, Barto, PA (US); Barbara Grzegorzewska, Riverside, IL (US)

(73) Assignee: Tyco Electronics Corporation, Berwyn, PA (US)

( * ) Notice: Subject to any disclaimer, the term of this patent is extended or adjusted under 35 U.S.C. 154(b) by 514 days.

(21) Appl. No.: 12/892,686

(22) Filed: Sep. 28, 2010

(65) Prior Publication Data

US 2012/0074875 A1 Mar. 29, 2012

(51) Int. Cl.
*H01H 31/02* (2006.01)
*H05B 37/00* (2006.01)

(52) U.S. Cl.
USPC ..... 324/556; 315/120

(58) Field of Classification Search
USPC ..... 315/120, 127, 129, 132, 133, 224, 315/291, 307, 247; 324/555, 556; 340/463, 340/464, 465
See application file for complete search history.

(56) References Cited

U.S. PATENT DOCUMENTS

| | | | | |
|---|---|---|---|---|
| 6,294,794 | B1 | 9/2001 | Yoshimura et al. | |
| 6,744,960 | B2 | 6/2004 | Pelka | |
| 7,002,458 | B2 * | 2/2006 | Su | 340/465 |
| 7,054,513 | B2 | 5/2006 | Herz et al. | |
| 7,102,152 | B2 | 9/2006 | Chua et al. | |
| 7,242,030 | B2 | 7/2007 | Wang et al. | |
| 7,274,150 | B2 * | 9/2007 | Takeda et al. | 315/77 |
| 7,326,908 | B2 | 2/2008 | Sargent et al. | |
| 7,638,947 | B2 * | 12/2009 | Ito et al. | 315/77 |
| 2006/0113895 | A1 | 6/2006 | Baroky et al. | |
| 2007/0025673 | A1 | 2/2007 | Bose et al. | |
| 2007/0249064 | A1 | 10/2007 | De La Fuente et al. | |
| 2007/0290765 | A1 | 12/2007 | Hsu | |
| 2008/0315177 | A1 | 12/2008 | Bose et al. | |
| 2009/0009057 | A1 | 1/2009 | Lee et al. | |
| 2010/0151733 | A1 | 6/2010 | Tsou | |

FOREIGN PATENT DOCUMENTS

WO WO 2010/019332 A2 2/2010

OTHER PUBLICATIONS

European Search Report, European Application No./Patent No. 11183519.5-1231, European Filing Date Feb. 22, 2012.

NANOSYS Nanotechnology Improves Ordinary LED Lighting; robaid.com; Jan. 12, 2010; 2 pgs.

* cited by examiner

*Primary Examiner* — Minh D A

(57) ABSTRACT

A lighting assembly includes a lighting module labeled with an indicator. The lighting module indicator is indicative of electrical capacities of the lighting module. A driver is provided to power the lighting module. The driver is labeled with an indicator indicative of electrical capacities of the driver. The lighting module indicator and the driver indicator are compared to determine whether the driver has electrical capacities that enable the driver to power the lighting module. A cable electrically couples the driver and the lighting module. The cable has an indicator indicative of electrical capacities of the cable. The cable indicator is compared to the driver indicators and the lighting module indicator to determine whether the cable has electrical capacities that enable the cable to convey power from the driver to the lighting module.

20 Claims, 4 Drawing Sheets

SSL BUDGETING AND CODING SYSTEM FOR LIGHTING ASSEMBLY

BACKGROUND OF THE INVENTION

The embodiments described herein relate to lighting assemblies and, more particularly, to a coding system for a lighting assembly.

LED lighting assemblies generally include at least one lighting module having LEDs thereon. The lighting module is joined to a driver that provides power to the LEDs. Typically, the driver has a cable extending therefrom. The lighting module is electrically coupled to the cable to provide power from the driver to the lighting module. Some lighting modules include a connector to join the lighting module to the cable. The connector includes contacts that are coupled to the LEDs of the lighting module. The contacts pierce a power pathway of the cable to convey an electrical signal from the cable to the LEDs. The connector may also include a splicing element that cuts the power pathway of the cable. Splicing the power pathway enables the electrical signal to be directed to the LEDs and back to the cable so that the cable can be joined to multiple lighting modules. An end of the cable is joined to a terminal that directs the electrical signal from the power pathway to a return pathway. The electrical signal is conveyed along the return pathway to the driver to complete a circuit for the lighting assembly.

However, conventional lighting assemblies are not without their disadvantages. The lighting modules and drivers are generally manufactured having various electrical capacities. For example, the lighting modules and the drivers may be manufactured to operate at one of various current and voltage capacities. Additionally, the cables and connectors may be manufactured to be operated at one of various currents. For the lighting assembly to operate properly, the current capacity of the lighting module, cable, and connector must match the current capacity of the driver. Moreover, the lighting module must be manufactured to operate at a voltage that is no greater than the voltage of the driver. In a system having multiple lighting modules, the combined voltage of the lighting module must be no greater than the voltage of the driver.

Generally, the components of the lighting assembly are sold separately. Additionally, those in the field of installing lighting assemblies may have an inventory of components having various electrical capacities. Accordingly, the components of the lighting assembly must be compared to ensure proper operation of the lighting assembly. In particular, the driver must be compared with corresponding lighting modules, cables, and connectors. Conventional lighting assemblies do not include labeling or nomenclature that enables a layperson to match the components. Accordingly, the lighting assembly may be improperly installed, thereby leading to inoperability of the assembly and/or damage to the assembly and/or the electrical system configured to power the assembly.

A need remains for a coding system to match the components of a lighting assembly.

SUMMARY OF THE INVENTION

In one embodiment, a lighting assembly is provided. The lighting assembly includes a lighting module labeled with an indicator. The lighting module indicator is indicative of electrical capacities of the lighting module. A driver is provided to power the lighting module. The driver is labeled with an indicator indicative of electrical capacities of the driver. The lighting module indicator and the driver indicator are compared to determine whether the driver has electrical capacities that enable the driver to power the lighting module. A cable electrically couples the driver and the lighting module. The cable has an indicator indicative of electrical capacities of the cable. The cable indicator is compared to the driver indicator and the lighting module indicator to determine whether the cables has electrical capacities that enable the cable to convey power from the driver to the lighting module.

In another embodiment, a lighting assembly is provided. The lighting assembly includes a lighting module labeled with an indicator indicative of a voltage capacity and a current capacity of the lighting module. A driver is provided to power the lighting module. The driver is labeled with an indicator indicative of a voltage capacity and a current capacity of the driver. The lighting module indicator and the driver indicator are compared to determine whether the driver has a current capacity and a voltage capacity that enable the driver to power the lighting module. A cable electrically couples the driver and the lighting module. The cable has an indicator indicative of the current capacity of the cable. The cable indicator is compared to the driver indicator and the lighting module indicator to determine whether the cable has a current capacity that enables the cable to convey power from the driver to the lighting module.

In another embodiment, a lighting assembly is provided. The lighting assembly includes a lighting module labeled with an indicator. The indicator includes a number and a symbol. The number and the symbol of the lighting module indicator are indicative of electrical capacities of the lighting module. A driver is provided to power the lighting module. The driver is labeled with an indicator including a number and a symbol. The number and the symbol of the driver indicator are indicative of electrical capacities of the driver. The lighting module indicator and the driver indicator are compared to determine whether the driver has electrical capacities that enable the driver to power the lighting module. A cable electrically couples the driver and the lighting module. The cable has an indicator indicative of electrical capacities of the cable. The cable indicator is compared to the driver indicator and the lighting module indicator to determine whether the cable has electrical capacities that enable the cable to convey power from the driver to the lighting module.

DETAILED DESCRIPTION OF THE DRAWINGS

The foregoing summary, as well as the following detailed description of certain embodiments will be better understood when read in conjunction with the appended drawings. As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Figure 1:
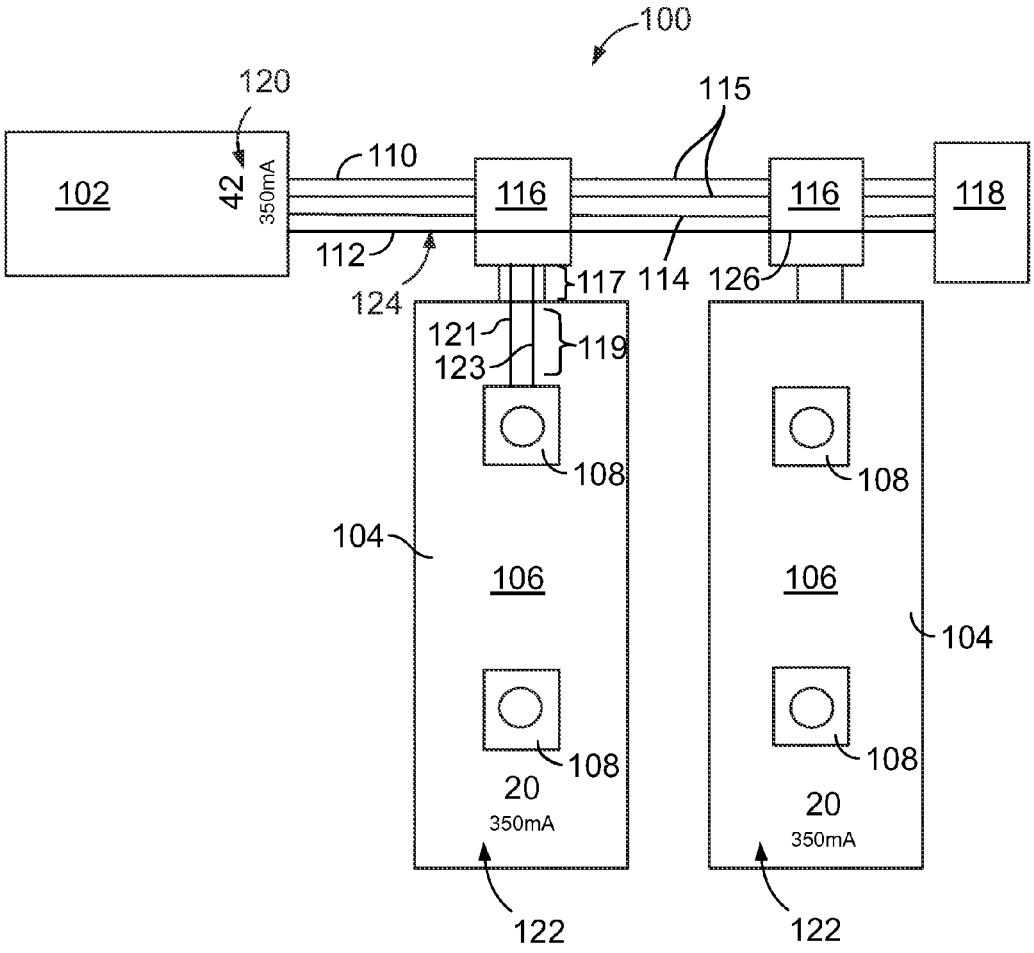
FIG. 1 is a schematic view of a lighting assembly formed in accordance with an embodiment.

FIG. 1 illustrates a lighting assembly 100 formed in accordance with an embodiment. The lighting assembly 100 includes a driver 102 having lighting modules 104 coupled thereto. The illustrated embodiment includes two lighting modules 104. Alternatively, the lighting assembly 100 may include any number of lighting modules 104. Each lighting module 104 includes a substrate 106 having LEDs 108 joined thereto. The substrate 106 may be a circuit board, for example, a printed circuit board or a flex circuit. The illustrated embodiment includes two LEDs 108 joined to each substrate 106. Alternatively, the substrates 106 may include any number of LEDs 108. The driver 102 is configured to power the LEDs 108.

A cable 110 is joined to the driver 102 to provide power to the LEDs 108. In the illustrated embodiment the cable 110 is a four pin ribbon cable. The cable 110 includes a power pathway 112 and a return pathway 114. The power pathway 112 directs an electrical current from the driver 102 to the lighting modules 104 to power the LEDs 108. The power pathway 112 powers the LEDs 108 on each lighting module 104. The cable 110 also includes thermocouple feedback wires 115 configured to direct to the driver 102, wherein the signal is indicative of a temperature of the assembly 100.

A connector 116 is joined to each lighting module 104. The connector 116 includes traces 117 that couple to traces 119 on the substrate 106. The traces 117 and 119 form a power pathway 121 and a return pathway 123. The traces 119 on the substrate 106 are joined to the LEDs 108. The connector 116 pierces the power pathway 112 to direct the electrical signal from the driver 102 to the LEDs 108 via the power pathway 121. The electrical signal is then directed from the LEDs 108 back to the power pathway 112 via the return pathway 123. The connector 116 includes a splicing mechanism to splice the power pathway 112 such that the electrical signal is directed to the LEDs 108 and back to the power pathways 112. The electrical signal can then be directed to the next lighting module 104.

The cable 110 is terminated at a terminal 118. The terminal 118 includes contacts (not shown) that engage the power pathway 112 and the return pathway 114 of the cable 110. The contacts join the power pathway 112 to the return pathway 114. The electrical signal is directed by the contacts from the power pathway 112 to the return pathway 114. The return pathway 114 directs the electrical signal back to the driver 102 to complete a circuit through the lighting assembly 100.

The driver 102 is provided with an indicator 120. The indicator 120 represents the electrical capacities of the driver 102. In an example embodiment, the indicator 120 includes a number and a symbol, for example, a color, a letter, and/or any other suitable symbol. In one embodiment, the number and the symbol are separate indicators. In the illustrated embodiment, the number and the symbol are combined. In the illustrated embodiment the number is colored. In one embodiment, the number of the indicator 120 indicates a voltage capacity of the driver 102. In the illustrated embodiment, the number of the indicator 120 is 42, thereby indicating that the driver 102 has a voltage capacity of 42 V. In an exemplary embodiment, for simplicity, the number of the indicator 120 does not include units. In one embodiment, the symbol of the indicator 120 indicates a current capacity of the driver 102. For example, the indicator 120 may be colored orange, wherein orange indicates that the driver 102 has a current capacity of 350 mA. In another embodiment, the indicator 120 may be colored a different color to indicate a different current capacity for the driver 102. For example, the color red may indicate a current capacity of 700 mA, the color green may indicate a current capacity of 1000 mA, and the color purple may indicate a current capacity of 2100 mA.

Each lighting module 104 is provided with an indicator 122. The indicator 122 represents the electrical capacities of the lighting module 104. In the example embodiment, the indicator 122 includes a number and a symbol, for example, a color, a letter, and/or any other suitable symbol. In one embodiment, the number and the symbol are separate indicators. In the illustrated embodiment, the number and the symbol are combined. In the illustrated embodiment the number is colored. In one embodiment, the number of the indicator 122 indicates a voltage capacity of the lighting module 104. In the illustrated embodiment, the number of the indicator 122 is 20, thereby indicating that the lighting module 104 has a voltage capacity of 20 V. In an exemplary embodiment, for simplicity, the number of the indicator 122 does not include units. In one embodiment, the symbol of the indicator 122 indicates a current capacity of the lighting module 104. For example, the indicator 122 may be colored orange, wherein orange indicates that the lighting module 104 has a current capacity of 350 mA. In another embodiment, the indicator 122 may be colored a different color to indicate a different current capacity for the lighting module 104.

The indicator 122 of the lighting module 104 is compared to the indicator 120 of the driver 102 to determine a compatibility between the lighting module 104 and the driver 102. The indicator 122 of the lighting module 104 is compared to the indicator 120 of the driver 102 to determine whether the driver 102 has electrical capacities that enable the driver 102 to power the lighting module 104. In one embodiment, the indicator 122 of the lighting module 104 is compared to the indicator 120 of the driver 102 to determine whether the driver 102 has a current capacity and a voltage capacity that enable the driver 102 to power the lighting module 104. The symbol of the indicator 122 of the lighting module 104 is compared to the symbol of the indicator 120 of the driver 102 to determine whether the current capacity of the lighting module 104 is compatible with the current capacity of the driver 102. To ensure proper operation of the lighting assembly 100, the driver 102 and the lighting module 104 must have an equivalent current capacity. For example, the indicator 120 of the driver 102 and the indicator 122 of the lighting module 104 may both be colored orange, thereby indicating that both the driver 102 and the lighting module 104 have a current capacity of 350 mA. If the symbol of the indicator 122 of the lighting module 104 matches the symbol of the indicator 120 of the driver 102, the driver 102 and the lighting module 104 have compatible current capacities. If the symbol of the indicator 122 of the lighting module 104 matches the symbol of the indicator 120 of the driver 102, the driver 102 the driver 102 has a current capacity that enables the driver 102 to power the lighting module 104.

The number of the indicator 122 of the lighting module 104 is compared to the number of the indicator 120 of the driver 102 to determine if the lighting module 104 and the driver 102 have compatible voltage capacities. The number of the indicator 122 of the lighting module 104 is compared to the number of the indicator 120 of the driver 102 to determine if the driver 102 has a voltage capacity that enables the driver 102 to power the lighting module 104. In an example embodiment, the voltage capacity of the lighting module 104 must be no greater than the voltage capacity of the driver 102. The number of the indicator 122 of the lighting module 104 must be no greater than the number of the indicator 120 of the driver 102. In the illustrated embodiment, each lighting module 104 has an indicator 122 having the number 20 and the driver 102 has an indicator 120 having the number 42. The number 20 of the indicator 122 of the lighting module 104 is no greater than the number 42 of the indicator 120 of the driver 102. Accordingly, each individual lighting module 104 having a voltage capacity of 20 V is compatible with a driver 102 having a voltage capacity of 42 V.

The illustrated embodiment includes a driver 102 joined to two lighting modules 104. To ensure proper function of the lighting assembly 100, the combined voltage capacity of the lighting modules 104 must be no greater than the voltage capacity of the driver 102. In the illustrated embodiment, the indicator 120 indicates that the voltage capacity of the driver 102 is 42 V. The indicators 122 of each lighting module 104 indicate that each lighting module 104 has a voltage capacity of 20 V. The numbers of the indicators 122 of each lighting module 104 are summed to determine if the lighting modules 104 in combination are compatible with the driver 102. In one embodiment, the numbers of the indicators 122 of each lighting module 104 are summed to determine if the driver 102 has electrical capacities that enable the driver 102 to power each lighting module 104. In one embodiment, the numbers of the indicators 122 of each lighting module 104 are summed to determine whether the driver 102 has a voltage capacity to power each of the lighting modules 104. The sum of the numbers of the indicators 122 of the lighting modules 104 equals 40. The sum of the numbers of the indicators 122 of the lighting modules 104 is no greater than the number of the indicator 120 of the driver 102. Accordingly, the combined voltage capacity of the two lighting modules 104 is compatible with the voltage capacity of the driver 102. As such, the driver 102 has a voltage capacity that enables the driver 102 to power each lighting module 104.

In one embodiment, the sum of the numbers of the indicators 122 of multiple lighting modules 104 may be greater than the number of the indicator 120 of a driver 102. In such an embodiment, the combined voltage capacity of the lighting modules 104 is too great for the driver 102. As such, the driver 102 would be incapable of power all of the lighting modules 104.

Alternatively, three lighting modules 104 having indicators with a number 10 may be combined to have a combined voltage capacity of 30 V. In such an embodiment, the combined voltage capacity of the three lighting modules 104 would be compatible with a driver 102 having a voltage capacity of 42. In another embodiment, any number of lighting modules 104 may be joined to the driver 102. The combined voltage capacity of all the lighting modules 104 must be no greater than the voltage capacity of the driver 102.

The cable 110 is provided with an indicator 124. In one embodiment, the indicator 124 includes a color. Alternatively, the indicator 124 may be a letter and/or any other suitable symbol. In the illustrated embodiment, the power pathway of the cable 110 is colored. Alternatively, the return pathway 114 may be colored. Optionally, the entire cable 110 may be colored. In one embodiment, the cable 110 may include a colored stripe. The indicator 124 indicates a current capacity of the cable 110. For example, the cable 110 may have an orange indicator 124 indicating that the cable 110 has a current capacity of 350 mA.

The indicator 124 of the cable 110 is compared with the indicator 120 of the driver 102 and the indicator 122 of the lighting module 104 to determine a compatibility between the cable 110 and the driver 102 and/or lighting module 104. The indicator 124 of the cable 110 is compared with the indicator 120 of the driver 102 and the indicator 122 of the lighting module 104 to determine whether the cable 110 has electrical capacities that enable the cable 110 to convey power between the driver 102 and the lighting module 104. In one embodiment, the indicator 124 of the cable 110 is compared with the indicator 120 of the driver 102 and the indicator 122 of the lighting module 104 to determine whether the cable 110 has a current capacity that enables the cable 110 to convey power between the driver 102 and the lighting module 104. For example, if the driver 102 and the lighting module 104 have orange indicators 120 and 122, respectively, the cable 110 has a current capacity that is equivalent to the current capacity of the driver 102 and the lighting module 104.

The connector 116 is provided with an indicator 126. In the illustrated embodiment, the indicator 126 includes a color. Alternatively, the indicator 126 may include a letter and/or any other suitable symbol. The indicator 126 indicates a current capacity of the connector 116. For example, the connector 116 may have an orange indicator 126 indicating that the connector 116 has a current capacity of 350 mA. The indicator 126 of the connector 116 is compared with the indicator 120 of the driver 102 and the indicator 122 of the lighting module 104 to determine a compatibility between the connector 116 and the driver 102 and/or lighting module 104. The indicator 126 of the connector 116 is compared with the indicator 120 of the driver 102 and the indicator 122 of the lighting module 104 to determine whether the connector 116 has electrical capacities that enable the connector 116 to convey power between the driver 102 and the lighting module 104. In one embodiment, the indicator 126 of the connector 116 is compared with the indicator 120 of the driver 102 and the indicator 122 of the lighting module 104 to determine whether the connector 116 has a current capacity that enables the connector 116 to convey power between the driver 102 and the lighting module 104. For example, if the driver 102 and the lighting module 104 have orange indicators 120 and 122, respectively, the connector 116 has a current capacity that is equivalent to the current capacity of the driver 102 and the lighting module 104.

The indicator 126 of the connector 116 may also indicate a compatibility with the cable 110. In one embodiment, the indicator 126 of the connector is compared to the indicator 124 of the cable 110 and the indicator 122 of the lighting module 104 to determine whether the connector 116 has electrical capacities that enable the connector 116 to convey power between the cable 110 and the lighting module 104. In one embodiment, the indicator 126 of the connector is compared to the indicator 124 of the cable 110 and the indicator 122 of the lighting module 104 to determine whether the connector 116 has a current capacity that enables the connector 116 to convey power between the cable 110 and the lighting module 104. For example, if the cable 110 has an orange indicator 124, the connector 116 has a current capacity that is equivalent to the current capacity of the cable 110.

Figure 2:
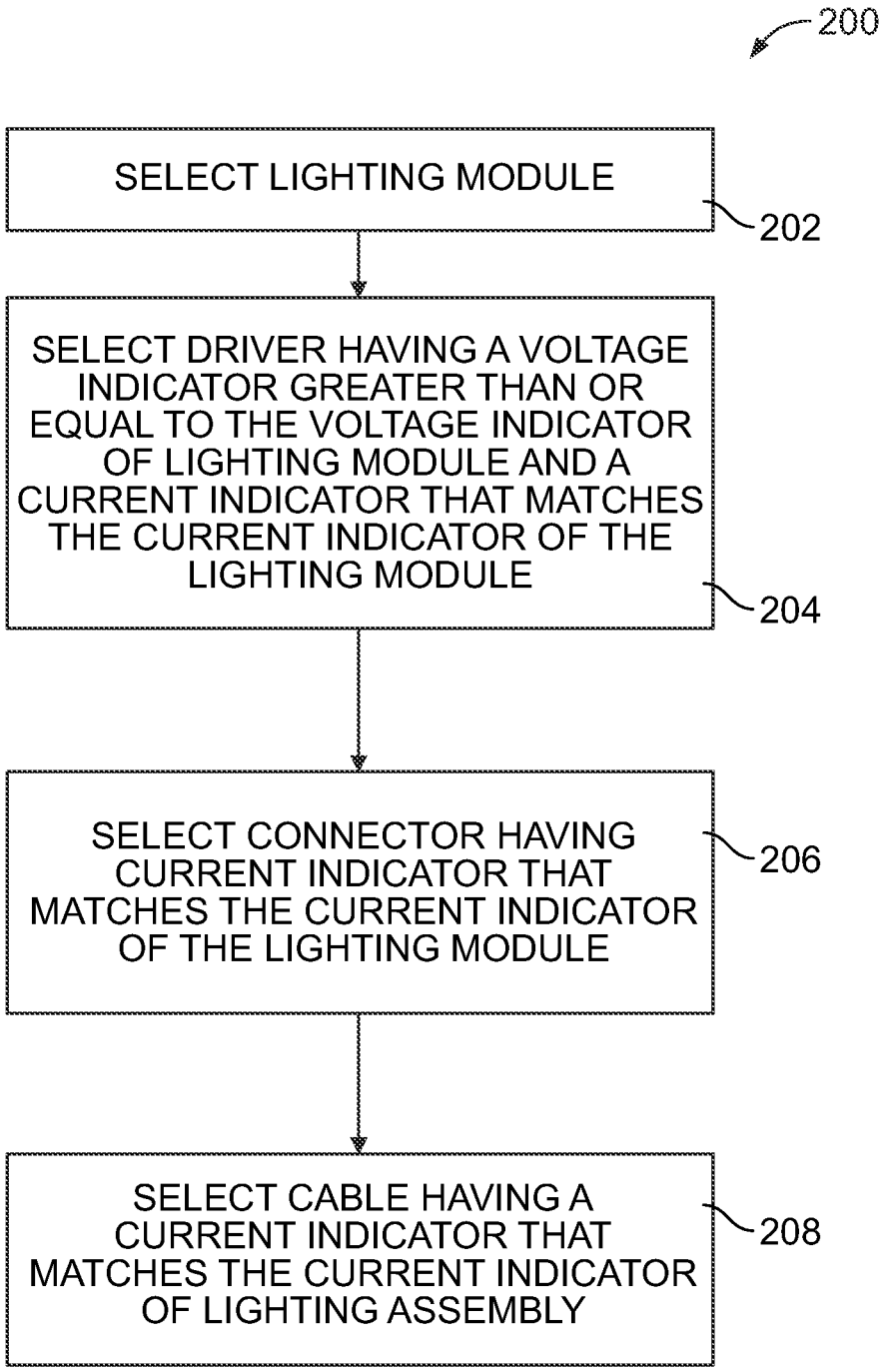
FIG. 2 is a flowchart illustrating a method of assembling a lighting assembly formed in accordance with an embodiment.

FIG. 2 illustrates a flowchart of a method 200 of assembling a lighting assembly 100. At step 202 a lighting module 104 is selected. The lighting module 104 is selected based on predetermined requirements of the lighting assembly 100. The lighting module 104 is selected based on a predetermined function and use of the lighting assembly 100. For example, the lighting module 104 may be selected based on a required or desired intensity of the lighting module 104. The lighting module 104 includes the indicator 122. The number of the indicator 122 identifies a voltage capacity of the lighting module 104. The symbol of the indicator 122 identifies a current capacity of the lighting module 104.

At step 204 a driver 102 is selected to power the lighting module 104. The driver 102 includes the indicator 120. The number of the indicator 120 identifies a voltage capacity of the driver 102. The symbol of the indicator 120 identifies a current capacity of the driver 102. The driver 102 is selected based on the indicator 122 of the lighting module 104. A driver 102 is selected having an indicator 120 with a symbol that matches the symbol of the indicator 122 of the lighting module 104. Matching the symbol of the indicator 120 to the symbol of the indicator 122 matches the current capacity of the driver 102 to the current capacity of the lighting module 104. The current capacities of the driver 102 and the lighting module 104 are compared to ensure compatibility between the driver 102 and the lighting module 104.

The driver 102 is selected having an indicator 120 with a number that is equal to or greater than the number of the indicator 122 of the lighting module 104. Matching the number of the indicator 120 with the number of the indicator 122 provides a voltage capacity of the driver 102 that is capable of powering the lighting module 104. To power the lighting module 104, the voltage capacity of the driver 102 must be equal to or greater than the voltage capacity of the lighting module 104.

At step 206 a connector 116 is selected for the lighting assembly 100. The connector 116 includes the indicator 126. The connector 116 is selected based on the indicator 126. A connector 116 is selected having an indicator 126 that matches the indicators 120 and 122 of the driver 102 and the lighting module 104, respectively. The indicator 126 identifies a current capacity of the connector 116. The connector 116 is selected to have a current capacity that matches the current capacity of the driver 102 and the lighting module 104.

At step 208 a cable 110 is selected for the lighting assembly 100. The cable 110 includes the indicator 124. The cable 110 is selected based on the indicator 124. A cable 110 is selected having an indicator 124 that matches the indicators 120, 122, and 126 of the driver 102, lighting module 104, and connector 116, respectively. The indicator 124 identifies a current capacity of the cable 110. The cable 110 is selected to have a current capacity that matches the current capacity of the driver 102, the lighting module 104, and the connector 116.

It should be noted that the steps 202-208 may be taken in any order. For example, the driver 102 may be selected before the lighting module 104 or the cable 110 may be selected before any other components. Regardless of the selection order, the indicators 120, 122, 124, and 126 are compared to ensure a compatibility of the components.

After selection of the components, the cable 110 is electrically coupled to the driver 102. The connector 116 is electrically coupled to the lighting module 104 such that the traces 117 and 119 are electrically joined. The connector 116 is joined to the cable 110 such that the connector pierces the power pathway 112 of the cable to provide power to the lighting module 104. The terminal 118 is joined to an end of the cable 110 so that the power pathways 112 are coupled to the return pathways 114.

Figure 3:
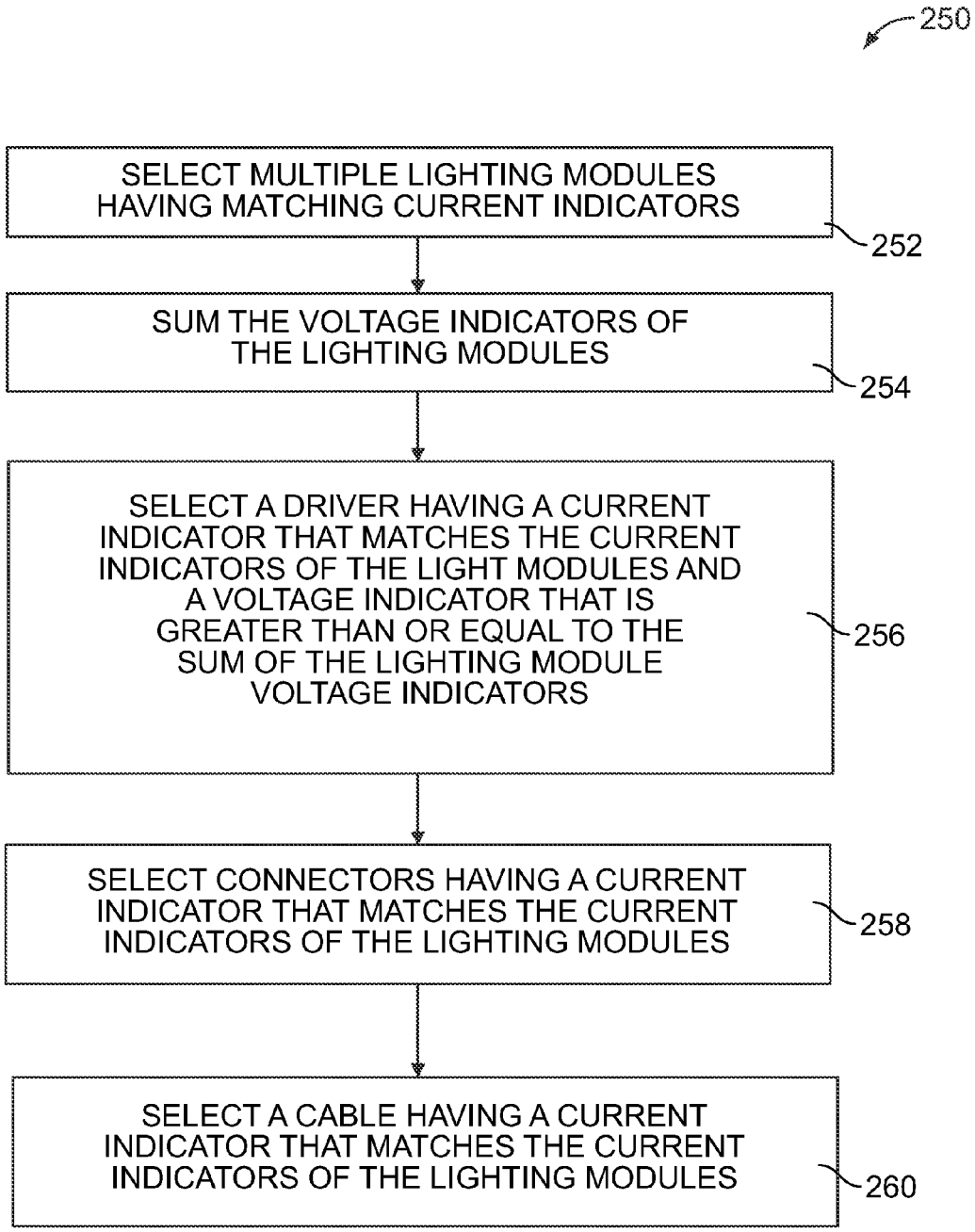
FIG. 3 is a flowchart illustrating another method of assembling a lighting assembly formed in accordance with an embodiment.

FIG. 3 is a flowchart illustrating another method 250 of assembling a lighting assembly 100. At step 252 multiple lighting modules 104 are selected. The lighting modules 104 are selected based on predetermined requirements of the lighting assembly 100 and a predetermined function and use of the lighting assembly 100. For example, the lighting modules 104 may be selected based on a required or desired intensity of the lighting modules 104. The lighting modules 104 include indicators 122. The numbers of the indicators 122 identify a voltage capacity of each lighting module 104. The symbols of the indicators 122 identify a current capacity of each lighting module 104. Each lighting module 104 selected has an indicator 122 with the same symbol to match the current capacities of the lighting modules 104. At step 254 the number of the indicator 122 of each lighting module 104 is summed to determine the total voltage capacity of the multiple lighting modules 104.

At step 256 a driver 102 is selected to power the lighting modules 104. The driver 102 includes the indicator 120. The number of the indicator 120 identifies a voltage capacity of the driver 102. The symbol of the indicator 120 identifies a current capacity of the driver 102. The driver 102 is selected based on the indicators 122 of the lighting modules 104. A driver 102 is selected having an indicator 120 with a symbol that matches the symbol of the indicators 122 of the lighting modules 104. Matching the symbol of the indicator 120 to the symbol of the indicator 122 matches the current capacity of the driver 102 to the current capacity of each lighting module 104. The current capacities of the driver 102 and the lighting modules 104 are compared to ensure compatibility between the driver 102 and the lighting modules 104.

The driver 102 is selected having an indicator 120 with a number that is equal to or greater than the sum of the numbers of the indicators 122 of the lighting modules 104. Matching the number of the indicator 120 with the sum of the numbers of the indicators 122 provides a voltage capacity of the driver 102 that is capable of powering all of the lighting modules 104. To power the lighting modules 104, the voltage capacity of the driver 102 must be equal to or greater than the total voltage capacity of the lighting modules 104.

At step 258 connectors 116 for each lighting module are selected for the lighting assembly 100. The connectors 116 include the indicator 126. The connectors 116 are selected based on the indicator 126. The connectors 116 are selected having indicators 126 that match the indicators 120 and 122 of the driver 102 and the lighting modules 104, respectively. The indicators 126 identify a current capacity of the connectors 116. The connectors 116 are selected to have a current capacity that matches the current capacity of the driver 102 and the lighting modules 104.

At step 260 a cable 110 is selected for the lighting assembly 100. The cable 110 includes the indicator 124. The cable 110 is selected based on the indicator 124. A cable 110 is selected having an indicator 124 that matches the indicators 120, 122, and 126 of the driver 102, the lighting modules 104, and the connectors 116, respectively. The indicator 124 identifies a current capacity of the cable 110. The cable 110 is selected to have a current capacity that matches the current capacity of the driver 102, the lighting modules 104, and the connectors 116.

It should be noted that the steps 252-260 may be taken in any order. For example, the driver 102 may be selected before the lighting modules 104 or the cable 110 may be selected before any other components. Regardless of the selection order, the indicators 120, 122, 124, and 126 are compared to ensure a compatibility of the components.

After selection of the components, the cable 110 is electrically coupled to the driver 102. The connectors 116 are electrically coupled to each lighting module 104 such that the traces 117 and 119 are electrically joined. The connectors 116 are joined to the cable 110 such that the connectors pierce the power pathway 112 of the cable to provide power to the lighting modules 104. The terminal 118 is joined to an end of the cable 110 so that the power pathways 112 are coupled to the return pathways 114.

Figure 4:
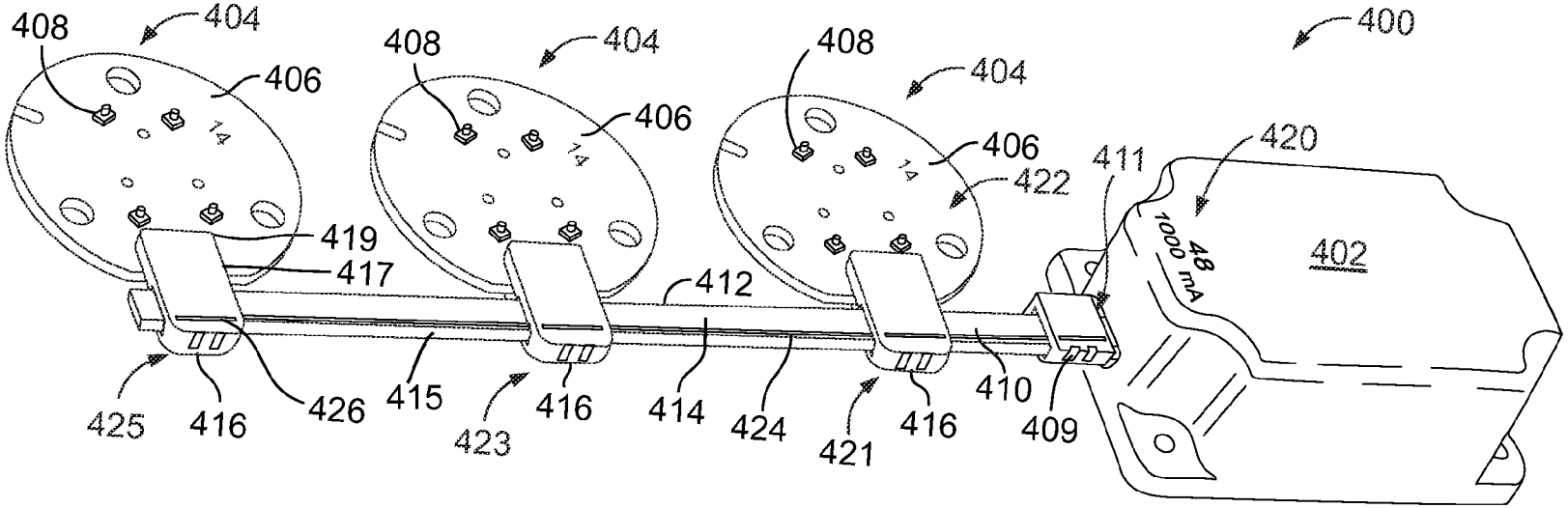
FIG. 4 is a perspective top view of a lighting assembly formed in accordance with another embodiment.

FIG. 4 illustrates a lighting assembly 400 formed in accordance with another embodiment. The lighting assembly 400 includes a driver 402 having lighting modules 404 coupled thereto. Each lighting module 404 includes a substrate 406 having LEDs 408 joined thereto. The driver 402 is configured to power the LEDs 408.

A cable 410 is joined to the driver 402 to provide power to the LEDs 408. The cable 410 includes a plug 409 that is inserted into a jack 411 of the driver 402. Alternatively, the driver 402 may include a plug that is inserted into a jack formed on the cable 410. In another embodiment, the cable 410 is wired directly to the driver 402 without a jack 411 or a plug 409. The cable 410 includes a power pathway 412 and a return pathway 414. The power pathway 412 directs an electrical current from the driver 402 to the lighting modules 404 to power the LEDs 408. The cable 410 also includes thermocouple feedback wires 415 configured to direct to the driver 402, wherein the signal is indicative of a temperature of the assembly 400.

A connector 416 is joined to each lighting module 404. The connector 416 includes a mating plug 417 couples to a mating clip 419 on the substrate 406 of the lighting module 404. Optionally, the connector 416 may include a clip and substrate 406 may include a plug. In another embodiment, the connector 416 may be formed integrally with the lighting module 404. The connector 416 pierces the power pathway 412 of the cable 410 to direct the electrical signal from the driver 402 to the LEDs 408. The electrical signal is then directed from the LEDs 408 back to the cable 410.

A first connector 421 directs the electrical signal from the LEDs 408 back to the power pathways 412. The electrical signal is then conveyed to a second connector 423 and a third connector 425. The third connector 425 operates as a terminal. The third connector 425 joins the power pathway 412 of the cable 410 to the return pathway 414 of the cable 410 to return the electrical signal to the driver 402.

The driver 402 is provided with an indicator 420 that represents the electrical capacities of the driver 402. A symbol of the indicator 420 represents the current capacity of the driver 402 and a number of the indicator 420 represents a voltage capacity of the driver 402. Each lighting module 404 is provided with an indicator 422 that represents the electrical capacities of the lighting module 404. A symbol of the indicators 422 represents the current capacity of each lighting module 404 and a number of the indicators 422 represents a voltage capacity of each lighting module 404.

The indicator 422 of each lighting module 404 is compared to the indicator 420 of the driver 402 to determine a compatibility between the lighting modules 404 and the driver 402. For example, the indicator 420 of the driver 402 may be colored green to indicate that the driver 402 has a current capacity of 1000 mA. Accordingly, lighting modules 404 are selected having an indicator 422 that is colored green to indicate a current capacity of 1000 mA. The number of the indicators 420 and 422 are also compared to match a voltage capacity of the driver 402 and the lighting modules 404. In the illustrated embodiment, each lighting module 404 includes a number 14 and the driver 402 includes a number 48. The sum of the indicators 422 of the lighting modules 404 must be no greater than the number of the indicator 420. In the illustrated embodiment, the sum of the indicators 422 is 42, which is no greater than the number 48 of the indicator 420 of the driver 402. Accordingly, the lighting modules 404 are compatible with the driver 402.

The cable 410 is provided with an indicator 424. In one embodiment, the indicator 424 includes the color green to represent a current capacity of the cable 410 of 1000 mA. The indicator 424 of the cable 410 is compared with the indicator 420 of the driver 402 and the indicator 422 of the lighting module 404 determine a compatibility between the cable 410 and the driver 402 and/or lighting module 404.

Connectors 416 are provided with indicators 426. In one embodiment, the indicators 426 include the color green to represent a current capacity of the connectors 416 of 1000 mA. The indicators 426 of the connectors 416 are compared with the indicator 420 of the driver 402 and the indicator 422 of the lighting module 404 to determine a compatibility between the connectors 416 and the driver 402 and/or lighting module 404. The indicators 426 of the connectors 416 may also indicate a compatibility with the cable 410.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the invention without departing from their scope. While the dimensions and types of materials described herein are intended to define the parameters of the various embodiments of the invention, the embodiments are by no means limiting and are exemplary embodiments. Many other embodiments will be apparent to those of skill in the art upon reviewing the above description. The scope of the various embodiments of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose the various embodiments of the invention, including the best mode, and also to enable any person skilled in the art to practice the various embodiments of the invention, including making and using any devices or systems and performing any incorporated methods. The patentable scope of the various embodiments of the invention is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. A lighting assembly comprising:

a lighting module labeled with an indicator, the lighting module indicator indicative of electrical capacities of the lighting module;

a driver to power the lighting module, the driver labeled with an indicator indicative of electrical capacities of the driver, wherein the lighting module indicator and the driver indicator are compared to determine whether the driver has electrical capacities that enable the driver to power the lighting module; and a cable electrically coupling the driver and the lighting module, the cable having an indicator indicative of electrical capacities of the cable, wherein the cable indicator is compared to the driver indicator and the lighting module indicator to determine whether the cable has electrical capacities that enable the cable to convey power from the driver to the lighting module.

2. The lighting assembly of claim 1, wherein lighting module indicator indicates a current capacity of the lighting module and the driver indicator indicates a current capacity of the driver, the lighting module indicator compared to the driver indicator to determine whether the driver has a current capacity that enables the driver to power the lighting module.

3. The lighting assembly of claim 1, wherein the lighting module indicator indicates a voltage capacity of the lighting module and the driver indicator indicates a voltage capacity of the driver, the lighting module indicator compared to the driver indicator to determine whether the driver has a voltage capacity that enables the driver to power the lighting module.

4. The lighting assembly of claim 1 further comprising multiple lighting modules joined to the driver, each lighting module having an indicator indicative of a voltage capacity of the lighting module, the driver indicator indicating a voltage capacity of the driver, the indicators of the multiple lighting modules compared to the driver indicator to determine whether the driver has a voltage capacity that enables the driver to power each of the multiple lighting modules.

5. The lighting assembly of claim 1, wherein the cable indicator indicates a current capacity of the cable.

6. The lighting assembly of claim 1 further comprising a connector joined between the cable and the lighting module, the connector having art indicator to indicate a current capacity of the connector.

7. The lighting assembly of claim 1, wherein the lighting module indicator includes a symbol that indicates a current capacity of the lighting module.

8. The lighting assembly of claim 1, wherein the driver indicator includes a symbol that indicates a current capacity of the driver.

9. The lighting assembly of claim 1, wherein the lighting module indicator includes a number that indicates a voltage capacity of the lighting module.

10. The lighting assembly of claim 1, wherein the driver indicator indicates includes a number that indicates a voltage capacity of the driver.

11. A lighting assembly comprising:

a lighting module labeled with an indicator indicative of a voltage capacity and a current capacity of the lighting module;

a driver to power the lighting module, the driver labeled with an indicator indicative of a voltage capacity and a current capacity of the driver, wherein the lighting module indicator and the driver indicator are compared to determine whether the driver has a current capacity and a voltage capacity that enable the driver to power the lighting module; and a cable electrically coupling the driver and the lighting module, the cable having an indicator indicative of the current capacity of the cable, wherein the cable indicator is compared to the driver indicator and the lighting module indicator to determine whether the cable has a current capacity that enables the cable to convey power from the driver to the lighting module.

12. The lighting assembly of claim 11, wherein the indicator of the lighting module includes a symbol to indicate the current capacity of the lighting module and the indicator of the driver includes a symbol to indicate the current capacity of the driver, the symbol of the lighting module indicator compared to the symbol of the driver indicator to determine whether the driver has a current capacity that enables the driver to power the lighting module.

13. The lighting assembly of claim 11, wherein the indicator of the lighting module includes a number to indicate the voltage capacity of the lighting module and the indicator of the driver includes a number to indicate the voltage capacity of the driver, the number of the lighting module indicator compared to the number of the driver indicator to determine whether the driver has a voltage capacity that enables the driver to power the lighting module.

14. The lighting assembly of claim 11 further comprising multiple lighting modules joined to the driver, each lighting module having a number to indicate the voltage capacity of the lighting module, the indicator of the driver having a number to indicate a voltage capacity of the driver, the sum of the numbers of the multiple lighting module indicators compared to the number of the driver indicator to determine whether the driver has a voltage capacity that enables the driver to power each of the multiple lighting modules.

15. The lighting assembly of claim 11, wherein the indicator of the cable includes a symbol to indicate the current capacity of the cable.

16. The lighting assembly of claim 11 further comprising a connector joined between the cable and the lighting module, the connector having an indicator to indicate a current capacity of the connector.

17. The lighting assembly of claim 16, wherein the indicator of the connector includes a symbol to indicate the current capacity of the connector.

18. A lighting assembly comprising:

a lighting module labeled with an indicator, the indicator including a number and a symbol, the number and the symbol of the lighting module indicator indicative of electrical capacities of the lighting module;

a driver to power the lighting module, the driver labeled with an indicator including a number and a symbol, the number and the symbol of the driver indicator indicative of electrical capacities of the driver, wherein the lighting module indicator and the driver indicator are compared to determine whether the driver has electrical capacities that enable the driver to power the lighting module; and a cable electrically coupling the driver and the lighting module, the cable having an indicator indicative of electrical capacities of the cable, wherein the cable indicator is compared to the driver indicator and the lighting module indicator to determine whether the cable has electrical capacities that enable the cable to convey power from the driver to the lighting module.

19. The lighting assembly of claim 18, wherein the symbol of the lighting module indicator indicates a current capacity of the lighting module and the symbol of the driver indicator indicates a current capacity of the driver, the symbol of the lighting module indicator compared to the symbol of the driver indicator to determine whether the driver has a current capacity that enables the driver to power the lighting module.

20. The lighting assembly of claim 18, wherein the number of the lighting module indicator indicates a voltage capacity of the lighting module and the number of the driver indicator indicates a voltage capacity of the driver, the number of the lighting module indicator compared to the number of the driver indicator to determine whether the driver has a voltage capacity that enables the driver to power the lighting module.

* * * * *